US005494465A

United States Patent [19]

Jenkins

[11] Patent Number: 5,494,465

[45] Date of Patent: Feb. 27, 1996

[54] PROPELLER PROTECTOR

[76] Inventor: David R. Jenkins, 9 Danygraig Avenue, Newton, Porthcaw, Mid-Glamorgan CF36 5AA, United Kingdom

[21] Appl. No.: 231,012

[22] Filed: Apr. 21, 1994

[51] Int. Cl.[6] ..... B63H 5/16

[52] U.S. Cl. ..... 440/71; 416/247 A

[58] Field of Search ..... 440/71, 72; 416/247 A; 114/145 A

[56] References Cited

U.S. PATENT DOCUMENTS

| | | | |
|---|---|---|---|
| 2,751,875 | 6/1956 | Henry | 114/145 A |
| 2,822,183 | 2/1958 | Montgomery | 440/72 |
| 3,587,508 | 6/1971 | Pearce | 150/52 |
| 3,802,377 | 4/1974 | Porter et al. . | |
| 3,889,624 | 6/1975 | Balius | 440/72 |
| 4,013,033 | 3/1977 | Porter et al. . | |
| 4,565,533 | 1/1986 | Springer | 440/71 |
| 4,699,597 | 10/1987 | Oja | 440/66 |
| 4,832,634 | 5/1989 | Kearns | 440/67 |
| 4,869,695 | 9/1989 | Sajdak, Jr. | 440/88 |
| 5,246,345 | 9/1993 | Adams, Jr. | 416/247 A |

FOREIGN PATENT DOCUMENTS

| | | |
|---|---|---|
| 0433510 | 6/1991 | European Pat. Off. . |
| 2152459 | 8/1985 | United Kingdom . |
| 2187695 | 9/1987 | United Kingdom . |
| 2213788 | 8/1989 | United Kingdom . |
| 2229412 | 9/1990 | United Kingdom . |

*Primary Examiner*—Sherman Basinger
*Attorney, Agent, or Firm*—Young & Thompson

[57] ABSTRACT

A propeller protector comprises a shield 18 which surrounds the aft face of the propeller and prevents access thereto. The shield 11 may be secured in position by guide surfaces which engage the lateral fins found on most outboard propeller drive shafts. The protector may be locked in position by a suitable strap.

9 Claims, 4 Drawing Sheets

PROPELLER PROTECTOR

This invention relates to a propeller protector and in particular, but not exclusively, to a protector for protecting the propeller and skeg of an outboard motor.

The edges of the propeller blades and the skeg of an outboard motor become jagged and sharp in use due to pitting. The unprotected propeller and skeg present many potential hazards. When a craft is being towed on land behind a vehicle, the outboard motor is in the out-of-water or horizontal position so that the propeller and skeg project from the stern of the craft. This can be hazardous to following vehicles as the drivers may not appreciate how far the propeller and skeg project and also to pedestrians who may bump into the propeller and skeg and injure themselves on the sharp edges, when the boat is reversed or stationary.

Furthermore when a craft is on the water the unprotected propeller can cause damage. With the increasing popularity of marinas and floating pontoons, boats are now tied up in a haphazard way with the motors in the out-of-water position and the propeller and skeg projecting rearwardly. When the boats jostle and move relative to each other the propellers and skegs can bump into adjacent boats and cause damage to both propeller and skeg and adjacent boats.

When a craft is beached, the propeller and skeg can cause injury if people tread on the propeller inadvertently. Also the propeller is at the right height to lean on and is also readily accessible to fiddling children.

There is also an increasing tendency for so-called joy riders to take a boat, run the motor until the petrol runs out, and then dump the boat.

When approaching moored boats to fend off, one tends to grab at the propellers of the moored boats and this can cause injury to the hands of the people fending off. In some cases outboard motors are stored on the mother ship. People may inadvertently stub their feet on the exposed propeller. Furthermore, there is a growing tendency for expensive propellers to be stolen from outboard motors. There is thus a need for some means of preventing thieves or vandals from gaining access to the propeller.

From a review of the potential hazards and security risks posed by unprotected propellers it is clear that there is a need for a protective article which reduces the possibility of injury to adjacent persons or property and which also makes it more difficult for unauthorised persons to drive the craft.

Accordingly, this invention provides a propeller protector comprising a shield means for obstructing or preventing access to the propeller of a marine craft and means for releasably securing the protector with respect to the propeller. The shield means faces the aft side of the propeller in use to block or obstruct the efflux therefrom.

The protector preferably obstructs access to the aft side of the propeller and includes longitudinal guide means for engaging in use a complementarily shaped part of the propeller drive shaft housing to allow the protector to be slid forwardly to at least partly surround the propeller.

The shield means preferably includes a tubular portion arranged to surround the propeller blades and an end wall closing the tubular portion and facing the propeller in use.

The tubular portion is preferably cylindrical and generally coaxial with the propeller's axis of rotation.

The shield means preferably is made of a tough plastics material such as for example polypropylene or natural or synthetic rubber material.

The shield means preferably includes an integrally formed handle. The shield is preferably imperforate and shaped as a scoop so that it may serve as a bailer.

The outer surface of the shield means is preferably brightly coloured, ideally a fluorescent warning red.

The releasable securing means preferably comprises a flexible tie or strap connected at one end to the protector and having attachment means at the other end to allow it to be lockably secured to the protector. The strap is preferably passed around the drive shaft housing of the outboard motor in use to secure the shield means. Advantageously, the flexible tie or strap includes releasable holding means cooperable with releasable holding means on the shield means (e.g. Velcro RTM or similar) to allow the strap to be held in position prior to locking.

The strap is preferably a webbing interwoven with metal e.g. stainless steel, threads or mesh to make it difficult to cut, or a stainless steel strop.

The protector preferably includes an elongate flexible tie for attaching it to an attachment point on the outboard motor or craft. This tie is preferably a shock cord or similar.

For increased security, the shield means may include means for preventing rotation of the propeller when the protector has been fitted. This may be in the form of a rib or other projection. Alternatively the shield means may include an inner flexible wall with the intermediate space filled with a fluid or gel material so that the inner wall deforms around the blades of the propeller to prevent rotation. The terms "aft" ""forward" and the like relate to the configuration in which the propeller is in an operative position with its rotary axis generally horizontal.

Whilst the invention has been described above it extends to any inventive combination of the features set out above or in the following description.

The invention may be performed in various ways and two embodiments thereof will now be described by way of example only, reference being made to the accompanying drawings, in which.

Figure 1:
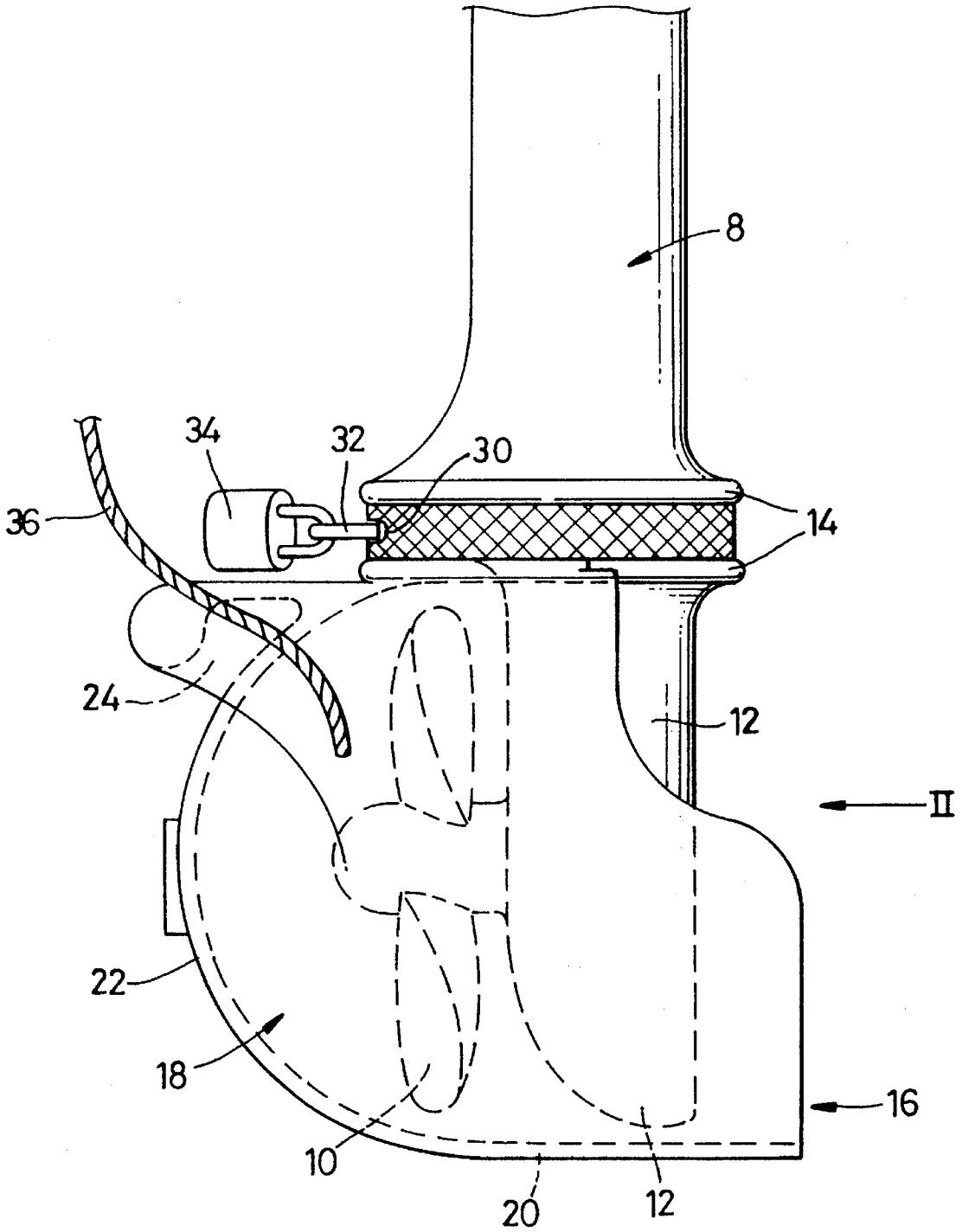
FIG. 1 shows the propeller and lower end of the drive shaft of an outboard motor fitted with a first embodiment of a propeller protector in accordance with this invention.
Figure 2:
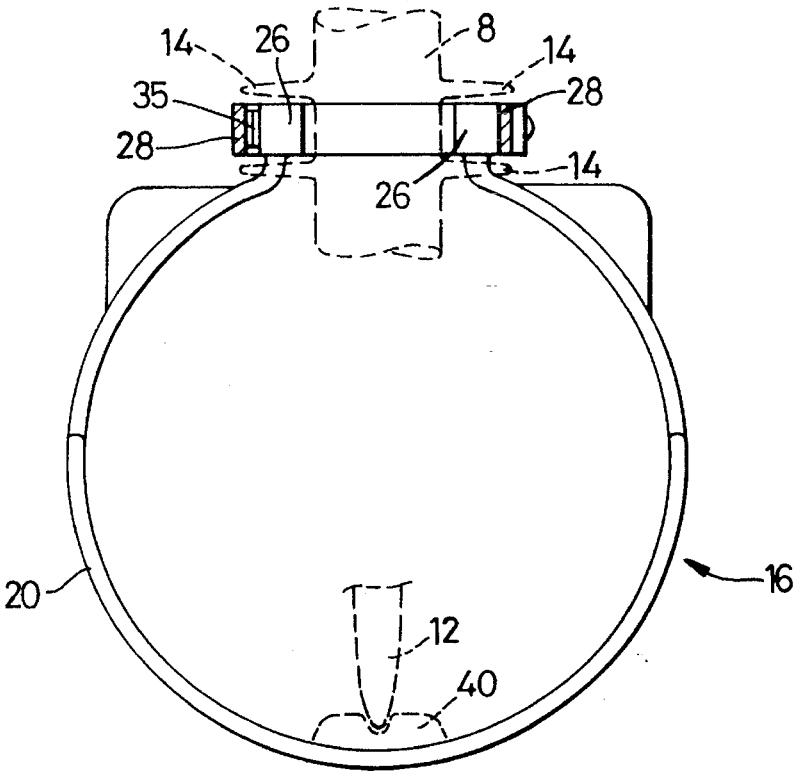
FIG. 2 is an end view of the propeller protector taken on arrows II of FIG. 1.
Figure 3:
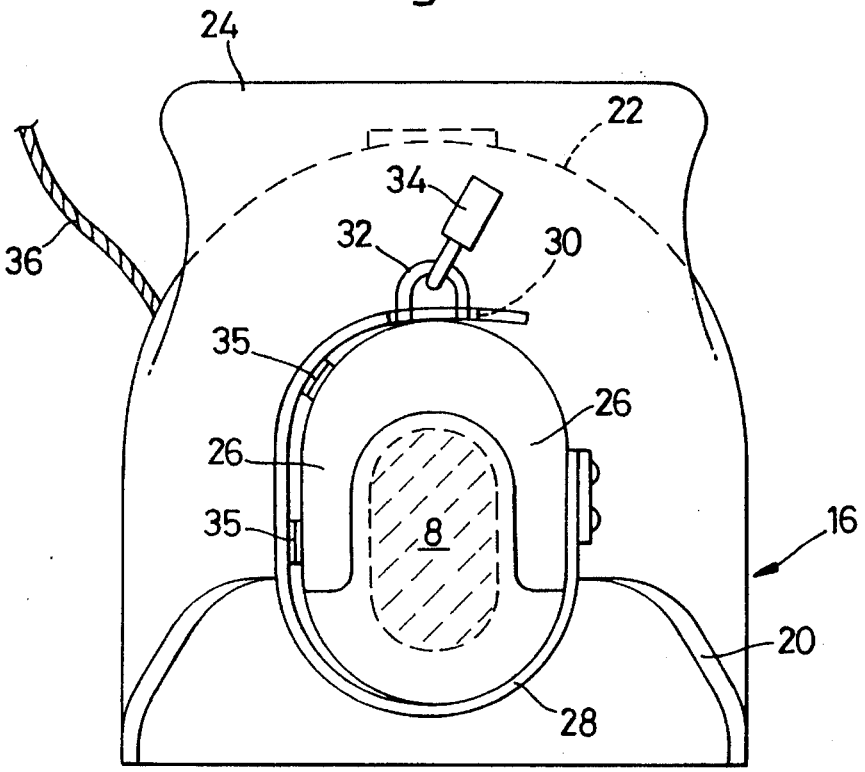
FIG. 3 is a top plan view of the propeller protector.

Referring initially to FIGS. 1 to 3, the outboard motor has a drive shaft housing 8 which supports at its lower end a propeller 10 and terminates with a skeg 12. Above the level of the propeller the housing 8 includes a pair of parallel spaced transverse fins 14.

The first embodiment of propeller protector 16 includes a shield 18 made of tough plastics such as polypropylene which includes a part cut away cylindrical wall 20 which merges with a hemispherical end wall 22. The shield has an integrally-formed handle 24 to allow it to be fitted and removed to the motor and also to allow the guard to be used as a bailer. The shield has a fluorescent outer finish in warning red.

The shield 18 includes on its upper region a pair of opposed longitudinal locating ribs 26 which engage in the channels defined by the spaced fins 14. The shield 18 is fitted by engaging the ribs 26 in the channels and then sliding the shield forwardly.

The protector is secured in use by a flexible stainless steel mesh reinforced locking strap 28 secured at one end to the upper part of the shield and having a closed slot 30 in the other end which can be passed over a locking staple 32 secured to the shield. The strap is then locked by a padlock 34. To assist initial location of the strap, there are provided complementary patches of Velcro 35 (RTM) material on the shield and the corresponding part of the strap.

A shock cord 36 is connected at one end to the shield and at the other to an attachment point on the motor or on the boat.

In the above arrangement, the shield is located with respect to the drive shaft by interengagement of the ribs 26 and the channels defined by the ribs 14. In addition and particularly for larger motors, further location may be provided by means of a channel piece 40 as shown in dotted lines in FIG. 2 located in the base of the shield for sliding onto the lowermost edge of the skeg 12.

As well as overcoming several if not all of the problems set out in the introduction, the propeller protector also serves as an emergency location aid. If a small craft breaks down at night or day the protector with its fluorescent finish can be held aloft as a beacon so the occupants can be seen more easily.

Figure 4:
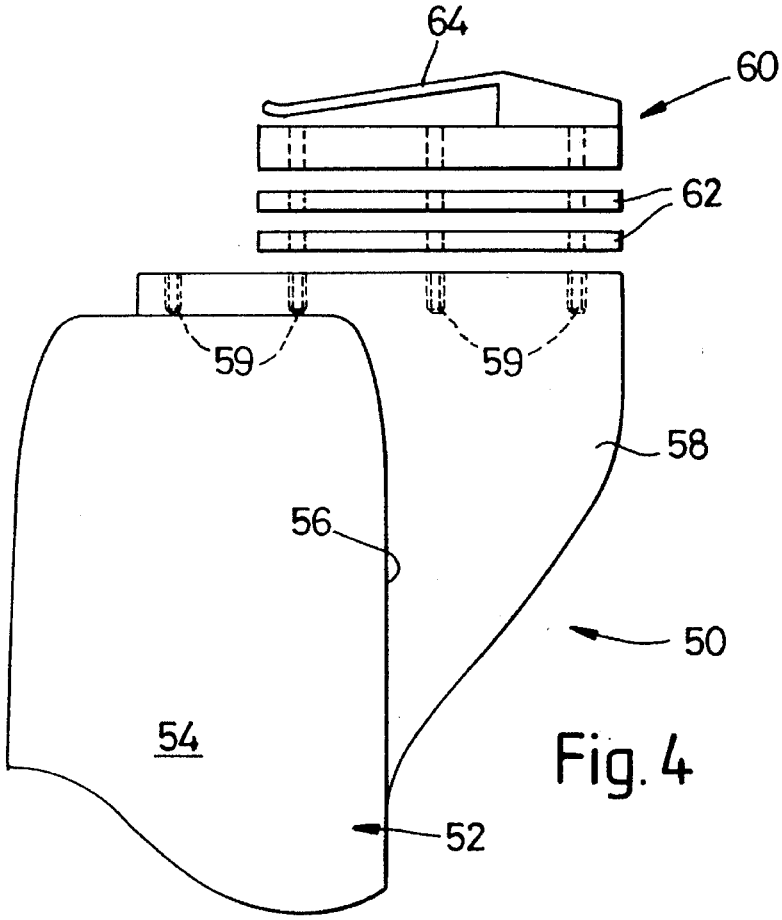
FIG. 4 is a side elevation of the upper part of a second embodiment of propeller protector in accordance with the invention.
Figure 5:
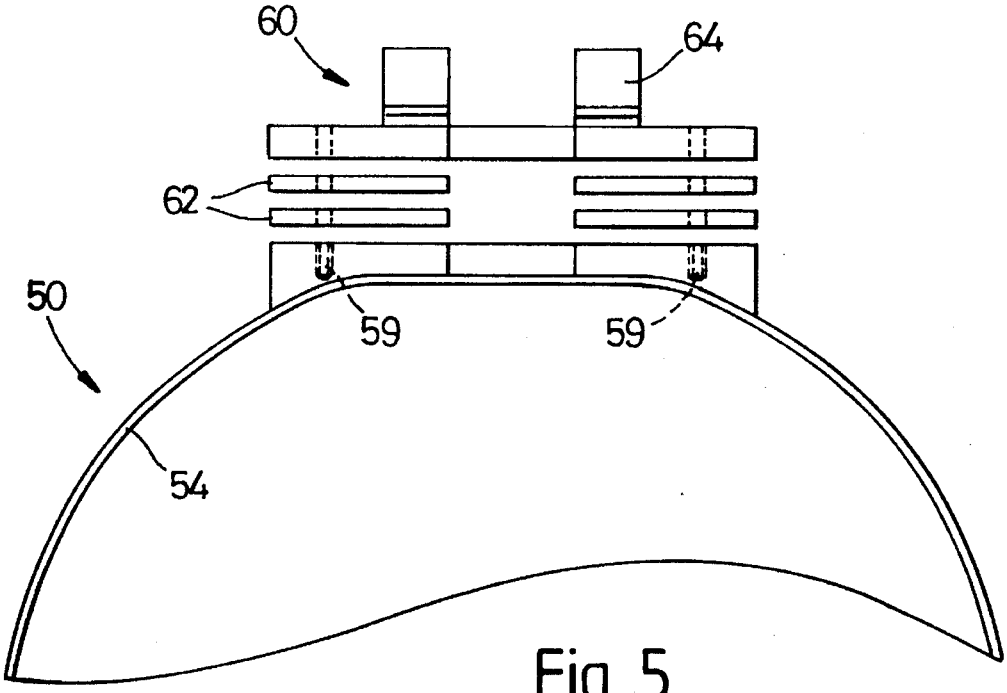
FIG. 5 is a front elevation of the upper part of the embodiment of FIG. 4.
Figure 6:
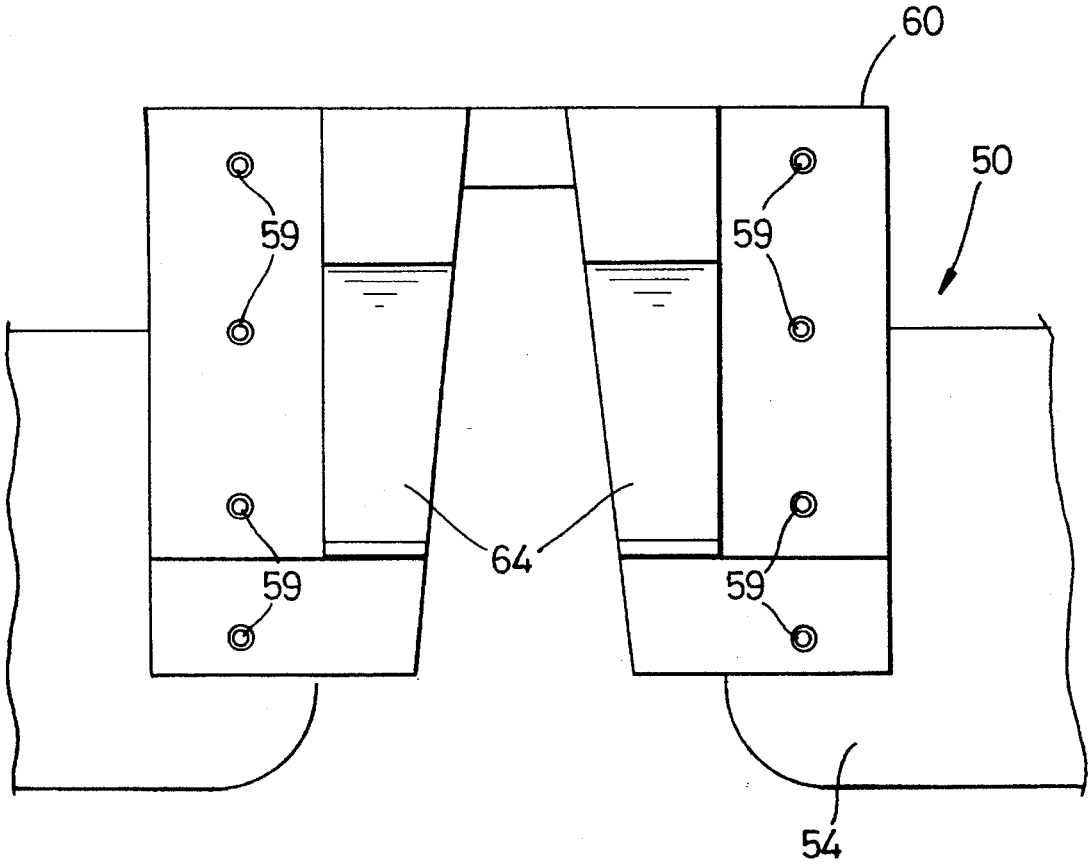
FIG. 6 is a top plan view of the upper part of the embodiment of FIGS. 4 and 5.

Referring to the second embodiment of propeller protector 50 illustrated in FIGS. 4 to 6, the protector comprises a shield 52 of tough plastics material which has a main body part comprising a generally cylindrical wall 54 closed at its forward end 56. The shield 52 has an integral handle 58 on the upper part of which there are a series of threaded bores 59 which receive fixing bolts (not shown) to secure a fixing head 60 and shims 62 as necessary. As best seen in FIG. 6, the upper part of the cylindrical wall is cut away to receive the drive shaft housing (not shown) of the outboard motor. Likewise the fixing head 60 is U-shaped in plan and has two spacing clips 64 which spring onto the transverse fins or ribs provided on most outboard motors (see fins 14 in FIGS. 1 and 2) to secure the protector to the lower end of the drive shaft with the shield 52 surrounding the propeller blade. The series of bores 59 and the shims 62 allow the propeller protector to be configured to suit most types of outboard motor on the market. The bores allow fore-and-aft adjustment and the shims allow vertical adjustment of the fixing head 60 relative to the shield 52.

It will be appreciated that features may be interchanged between the two embodiments, for example, the locking features of the first embodiment may be adopted in the second, or the second embodiment could incorporate adjustment between the locating ribs 26 and the rest of the shield 18.

I claim:

1. A protector for a propeller mounted at a lower end of a drive shaft housing that has two laterally directed cavitation fins disposed on the housing above the propeller, said propeller protector being operable to obstruct or prevent access to said propeller and comprising shield means including a generally imperforate end wall region for facing the aft side of a propeller in use to block or obstruct the efflux therefrom, further wall means merging with said imperforate end wall region generally circumferentially to surround a said propeller, and engagement means for engaging in use a said drive shaft housing on or adjacent said cavitation fins, thereby releasably to secure the shield means with respect to a said propeller, wherein said engagement means comprises a longitudinal guide means whereby in use the protector may be slid forwardly to at least partially surround a said propeller, said engagement means being secured to said shield means by a connection arrangement which allows adjustment of the spacing of the longitudinal guide means relative to the shield means in at least one direction.

2. A propeller protector according to claim 1, wherein said connection arrangement includes fastening means engageable with a selected one or set of a plurality of complementary fastening means to allow adjustment in one direction.

3. A propeller protector according to claim 1, wherein the connection arrangement includes shim means.

4. A propeller protector according to claim 1, wherein the shield means is made of a tough plastics material.

5. A propeller protector according to claim 4, wherein said shield means is made of polypropylene or natural or synthetic rubber material.

6. A propeller protector according to claim 1, wherein the shield means includes an integrally formed handle.

7. A propeller protector according to claim 1, wherein the shield is imperforate and shaped as a scoop so that it may serve as a bailer.

8. A propeller protector according to claim 1, wherein at least the outer surface of the shield means is brightly coloured.

9. A propeller protector according to claim 8, wherein the outer surface of the shield means is a fluorescent warning red colour.

* * * * *

UNITED STATES PATENT AND TRADEMARK OFFICE

CERTIFICATE OF CORRECTION

PATENT NO. : 5,494,465

DATED : February 27, 1996

INVENTOR(S) : David Robert JENKINS

It is certified that error appears in the above—identified patent and that said Letters Patent is hereby corrected as shown below:

Title page, item [76], change "Porthcaw," to --Porthcawl--.

Signed and Sealed this

Twenty-first Day of May, 1996

Bruce Lehman

*Attest:*

BRUCE LEHMAN

*Attesting Officer*

*Commissioner of Patents and Trademarks*